US005996778A

United States Patent [19]

Shih

[11] Patent Number: 5,996,778

[45] Date of Patent: Dec. 7, 1999

[54] STRUCTURE OF MARKERS BOX

[75] Inventor: Ching-Wen Shih, Taipei, Taiwan

[73] Assignee: Two Powers Enterprise Co., Ltd., Taipei, Taiwan

[21] Appl. No.: 08/987,921

[22] Filed: Dec. 9, 1997

[51] Int. Cl.[6] ..... B65D 51/04

[52] U.S. Cl. ..... 206/45.2; 206/45.24; 206/214; 206/224

[58] Field of Search ..... 206/45.2, 45.21, 206/45.22, 45.23, 214, 224, 371, 45.24, 45.25

[56] References Cited

U.S. PATENT DOCUMENTS

| | | | |
|---|---|---|---|
| 2,385,268 | 9/1945 | Gillam | 206/45.22 |
| 2,585,361 | 2/1952 | Williamson | 206/45.22 |
| 4,395,056 | 7/1983 | Sferragatta | 206/45.21 |
| 4,651,872 | 3/1987 | Joyce | 206/45.24 X |
| 5,271,502 | 12/1993 | Chang | 206/45.23 |
| 5,435,437 | 7/1995 | Sasaki | 206/45.23 |
| 5,667,064 | 9/1997 | Bauman | 206/214 |

*Primary Examiner*—Jacob K. Ackun
*Attorney, Agent, or Firm*—Bacon & Thomas

[57] ABSTRACT

The invention provides an improved structure of markers box, which can mainly fold back plate, top plate and front plate into a slotted part for receiving markers. The slotted part can be in an upstanding state with several angles. A hook and loop tape or the like is provided at the front and bottom of the slotted part as well as at the front side and rear side of the front plate respectively. A stabile state is formed by above-mentioned folded structural body in order to draw off and insert markers.

3 Claims, 3 Drawing Sheets

A–A Sec.

FIG. 4
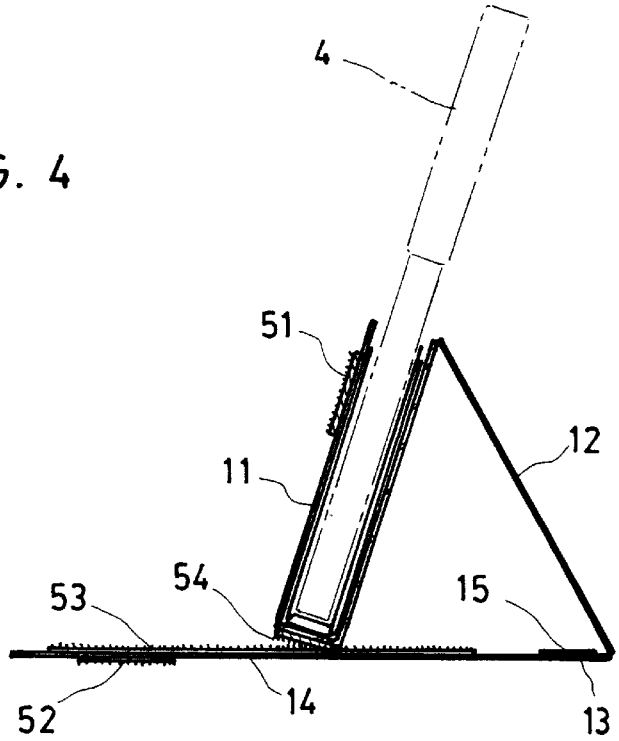
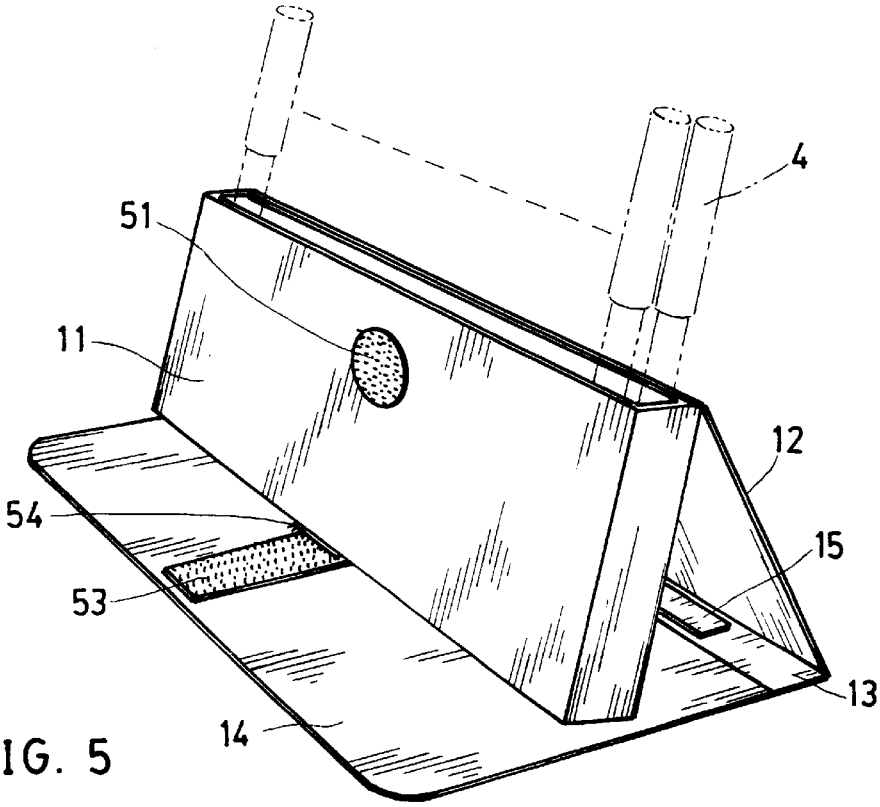
FIG. 5

STRUCTURE OF MARKERS BOX

FIELD OF THE INVENTION

The invention relates to a structure of box, particularly to a box body structure for receiving markers in whole row form.

BACKGROUND OF THE INVENTION

For conventional markers boxes the whole markers boxes are usually lay on the desk after drawing off a certain or several markers. These markers are usually lay on the desk, which is at random because the insertion of markers is not smooth or facile. Such state which is a convention long-followed often leads to the distributing the box body and the markers over the desk and a state in which many spaces are occupied.

SUMMARY OF THE INVENTION

This invention provides a state in which the whole markers box can form a stabile standing with a certain angle (adjustable) and the markers can easily draw off or insert. Therefore, the invention provides also a good conditions for a neatness of the desk.

The cover part of the markers box is made as a invertible folded structure according to the invention. At several postitions are provided with hook and loop tape with which the box body can form a standing state which is suited for the application by user and the markers form an angle which is suited to draw off or insert; Due to the structure of the invention, which is easy to assemble, use and pack, therefore, which is not easy to distribute, the occupied space is naturally reduced.

The hook and loop tape of the invention provides mainly a connection which is correspondently tight by a slight pressing, which can be separated by applying several forces, and which is a known component for repeatable use; Such component applied by the invention can mainly provide a stability with correspondent degree for a assembled state to be attained.

The object of the invention is folding the markers box into a stabile standing state for use.

BRIEF DESCRIPTION OF THE DRAWINGS

FIG. 4 is a sectional view in which the invention is in an assembled state, FIG. 5 is an other perspective view of the invention.

DETAILED DESCRIPTION OF PREFERRED EMBODIMENT

Figure 1:
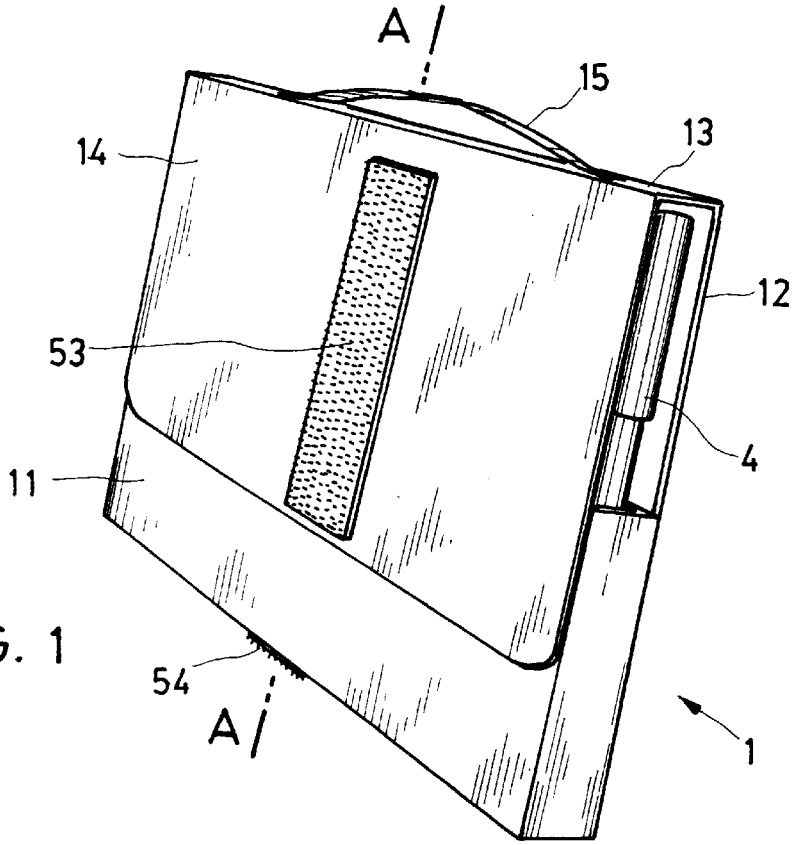
FIG. 1 is a perspective view of the invention.
Figure 2:
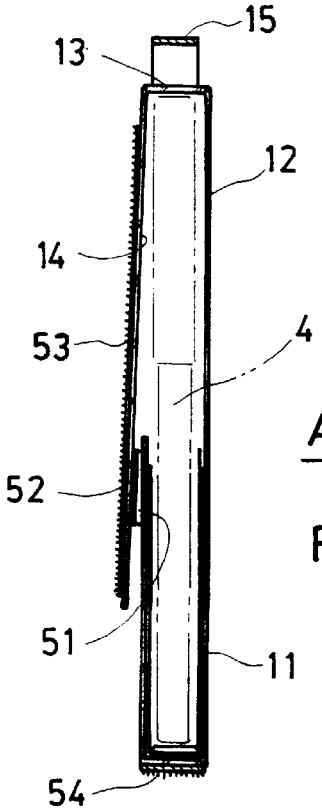
FIG. 2 is a sectional view taken from line A—A in FIG. 1.
Figure 3:
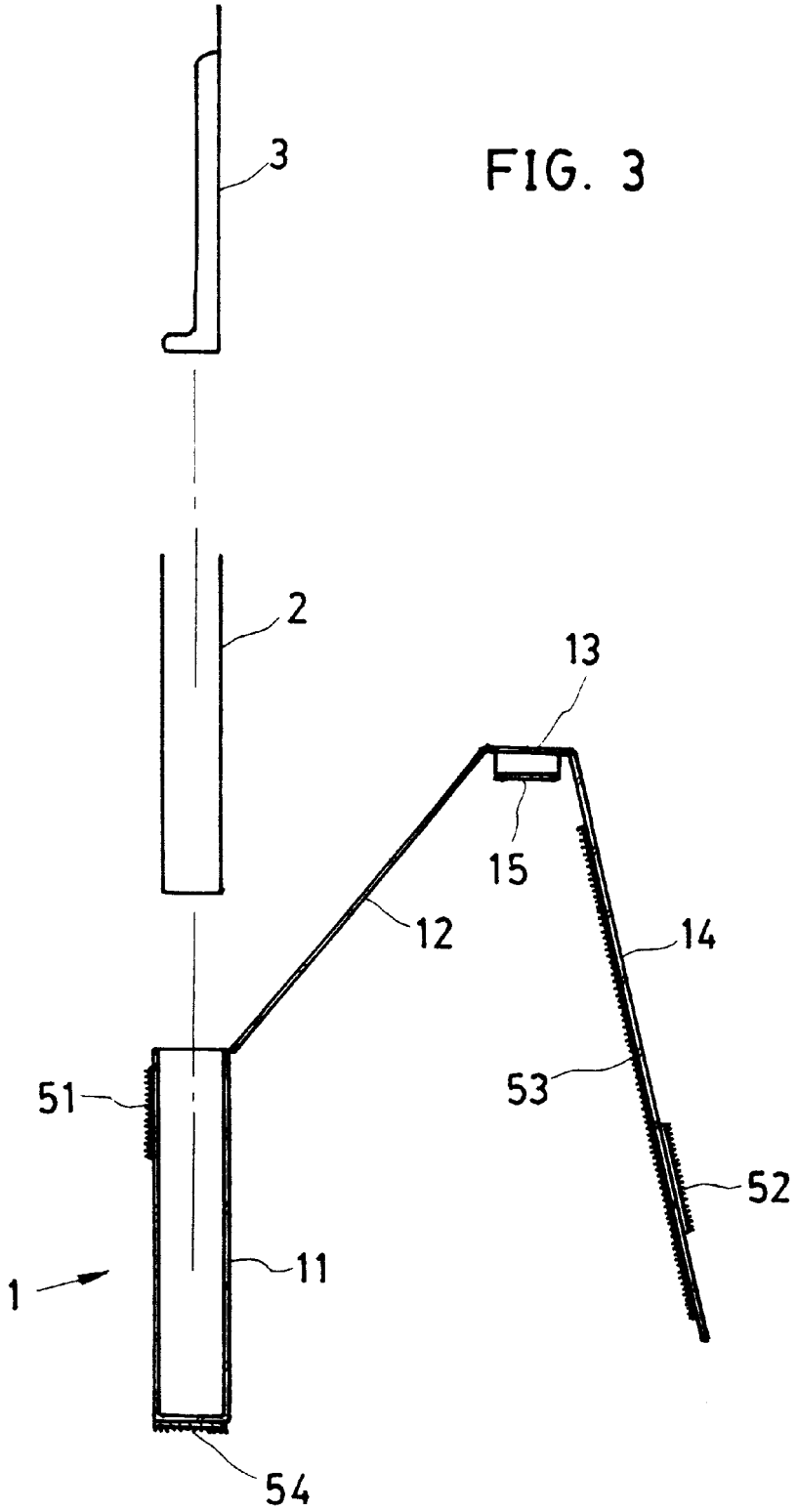
FIG. 3 is a sectional view in which the invention is in an unassembled state.

As shown in FIG. 1–3, the constitution of the invention includes mainly a receiving box 1, several reinforced members inside of box 2, 3, markers 4 and so on. Wherein the receiving box 1 includes a slotted part 11, a back plate 12, a top plate 13, a front plate 14 and several hook and loop tapes.

As shown in FIG. 1, the invention is in a box body form, its inner receives markers 4, a handle 15 is provided on the top plate 13, which is movable and placing evenly on the top plate 13.

As shown in FIG. 2, 3, 4, several hook and loop tapes are fixed on the receiving box 1, the hook and loop tape 51 at front of the slotted part 11 matches the hook and loop tape 52 at inside of the front plate 14, the hook and loop tape 53 on the front plate 14 matches the hook and loop tape 54 at the bottom of the slotted part 11. Above-mentioned hook and loop tapes 51, 52 are bonded each other when which are in a state as shown in FIG. 1 and 2 wherein the markers are covered with the markers box; the hook and loop tapes 53, 54 are bonded each other when the markers box is folded into a markers box in a state for use as shown in FIG. 4, 5.

Above-mentioned between slotted part 11 of receiving box and the back plate 12, the back plate 12 and the top plate 13, the top plate 13 and the front plate 14 are 4 prepressed with fold lines, and the characteristic of material is used for repeated bending more times.

When the markers 4 is to be used, the hook and loop tape 51, 52 are separated through opening the front plate 14 which is bent backward, at same time, the back plate 12 with the slotted part 11 are along preformed fold lines bent and form a state as shown in FIG. 2, the hook and loop tape 54 at bottom of the slotted part 11 with the hook and loop tape inside of the front plate 14 are then bonded each other, i.e. a stabile state is formed as shown in FIG. 4, 5, which is using the front plate 14 as a bottom. The different standing angles can be formed according to the change of the bonded position.

Reinforced members 2, 3 are a conventional member and are not absolutely necessary, which are used for reinforcing the structure of the box body in the invention, and provide a stabile inserted state for markers 4.

By means of the characteristics for providing the hook and loop tape 51, 52, 53 and a bendable receiving box 1, which are a illustrated above, the structure of the invention can form a closed or opened state for use and the structural state is stabile because the preset hook and loop tape.

According to the spirit of the invention, above-mentioned hook and loop tapes 51, 52, 53, 54 can change into different hook and loop article or the like for obtaining the same object, which should belong in the range of claims of the invention.

What is claimed is:

1. A marker storage box, comprising:

a storage compartment;

a reinforced liner arranged in said storage compartment and having an opening for receiving and storing a plurality of markers arranged in a row;

a first hook and loop fastener arranged on an outside bottom surface of the storage compartment;

a back plate hinged to the storage compartment by a fold near the opening of the liner;

a front plate hinged to a second edge of the back plate, the second edge of the back plate being opposite the first edge of the back plate;

a second fastener arranged on an outside of the front plate including a strip of hook and loop tape arranged substantially perpendicular to the first edge of said front plate hinge for securing said liner in said storage compartment at various angles when the box is in an open free-standing configuration;

a third hook and loop fastener arranged on an outside front surface of said storage compartment; and a fourth hook and loop fastener arranged on an inside surface of said front plate for releaseably securing to the third fastener and maintaining the box in a closed configuration with the markers inside the box.

2. The marker storage box recited in claim 1, wherein said front and back plates are hinged with a top plate, said top plate being arranged between the first edge of the front plate and the second edge of the back plate.

3. The marker storage box recited in claim 2, further comprising a handle arranged on an outer surface of said top plate.

* * * * *